US008123530B2

(12) United States Patent
Chen et al.

(10) Patent No.: US 8,123,530 B2
(45) Date of Patent: Feb. 28, 2012

(54) LOWER PROFILE ELECTRICAL SOCKET

(75) Inventors: Ming-Yue Chen, Tu-Cheng (TW); Ke-Hao Chen, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/916,649

(22) Filed: Nov. 1, 2010

(65) Prior Publication Data

US 2011/0269351 A1 Nov. 3, 2011

(51) Int. Cl.
*H01R 12/00* (2006.01)

(52) U.S. Cl. ..... 439/66

(58) Field of Classification Search ..... 439/71, 439/660, 876, 66, 785, 68, 83
See application file for complete search history.

(56) References Cited

U.S. PATENT DOCUMENTS 6,056,558 A * 5/2000 Lin et al. ..... 439/83
6,554,634 B1 4/2003 Lin et al.
6,679,709 B2 * 1/2004 Takeuchi ..... 439/83
6,692,265 B2 * 2/2004 Kung et al. ..... 439/68
6,731,516 B1 * 5/2004 Ma ..... 361/802
7,052,289 B1 * 5/2006 Hao ..... 439/83
7,147,489 B1 * 12/2006 Lin ..... 439/83
7,189,080 B2 * 3/2007 Tang et al. ..... 439/66
7,484,985 B2 * 2/2009 Wang et al. ..... 439/342
2003/0166347 A1 * 9/2003 Noda et al. ..... 439/71
2005/0233606 A1 * 10/2005 Liao et al. ..... 439/66

* cited by examiner

*Primary Examiner* — Jean F Duverne
(74) *Attorney, Agent, or Firm* — Andrew C. Cheng; Wei Te Chung; Ming Chieh Chang

(57) ABSTRACT

An electrical socket comprises an insulative housing having an upper surface extending along a first direction, a number of contacts received in the insulative housing, and a plurality of solder mass received in the housing and located aside a base portion of a contact, respectively. The contact comprises a base portion for retaining the contact received in the housing, a contacting portion extending from the base portion. The solder mass, the base portion and the contacting portion are disposed in a manner of one by one along the first direction. The electrical contact has a lower profile. The electrical socket is benefited with low profile suitable for compact and thin applications.

20 Claims, 6 Drawing Sheets

LOWER PROFILE ELECTRICAL SOCKET

BACKGROUND OF THE INVENTION

1. Field of the Invention

The present invention relates to an electrical socket, and more particularly to an electrical socket having a lower profile structure thereby lowering and benefiting an overall height of the socket for compact application.

2. Description of Prior Art

U.S. Pat. No. 6,554,634 issued to Liao on Apr. 29, 2003 discloses a conventional electrical contact and electrical socket for electrically connecting a pin of an electrical package and a PCB (printed circuit board). The electrical contact 1 of the electrical socket comprises a base portion 10 extending in a vertical direction, an engaging portion 11 extending from a top end of the base portion 10, and a solder pad 12 extending from a bottom end of the base portion 10. The engaging portion 11 and the solder pad 12 also extend along the vertical direction.

However, such conventional contact may not be fitted in certain application, such a thin and compact environment. The base portion, engaging portion and the solder pad are disposed at positions having different heights relative to a same horizontal plane. In other words, the three portions are disposed at different horizontal plane. Therefore, the whole height of the electrical contact is comparably bulky for the above-described application. Accordingly, it is inevitable that a socket incorporated with such contact will also be suffered with a bulky dimension not suitable for compact and thin application.

In view of the above, an improved electrical contact and electrical socket that overcomes the above-mentioned disadvantages is desired.

SUMMARY OF THE INVENTION

Accordingly, an object of the present invention is to provide an electrical socket benefited with low profile suitable for compact and thin applications.

To achieve the above-mentioned object, an electrical contact comprises an insulative housing having an upper surface extending along a first direction, a number of contacts received in the insulative housing, and a plurality of solder mass received in the housing and located aside a base portion of a contact, respectively. The contact comprises a base portion for retaining the contact received in the housing, a contacting portion extending from the base portion. The solder mass, the base portion and the contacting portion are disposed in a manner of one by one along the first direction. The electrical contact has a lower profile. The electrical socket is benefited with low profile suitable for compact and thin applications.

Other objects, advantages and novel features of the invention will become more apparent from the following detailed description when taken in conjunction with the accompanying drawings, in which:

DETAILED DESCRIPTION OF THE PREFERRED EMBODIMENT OF THE INVENTION

Reference will now be made to the drawings to describe the present invention in detail.

Figure 1:
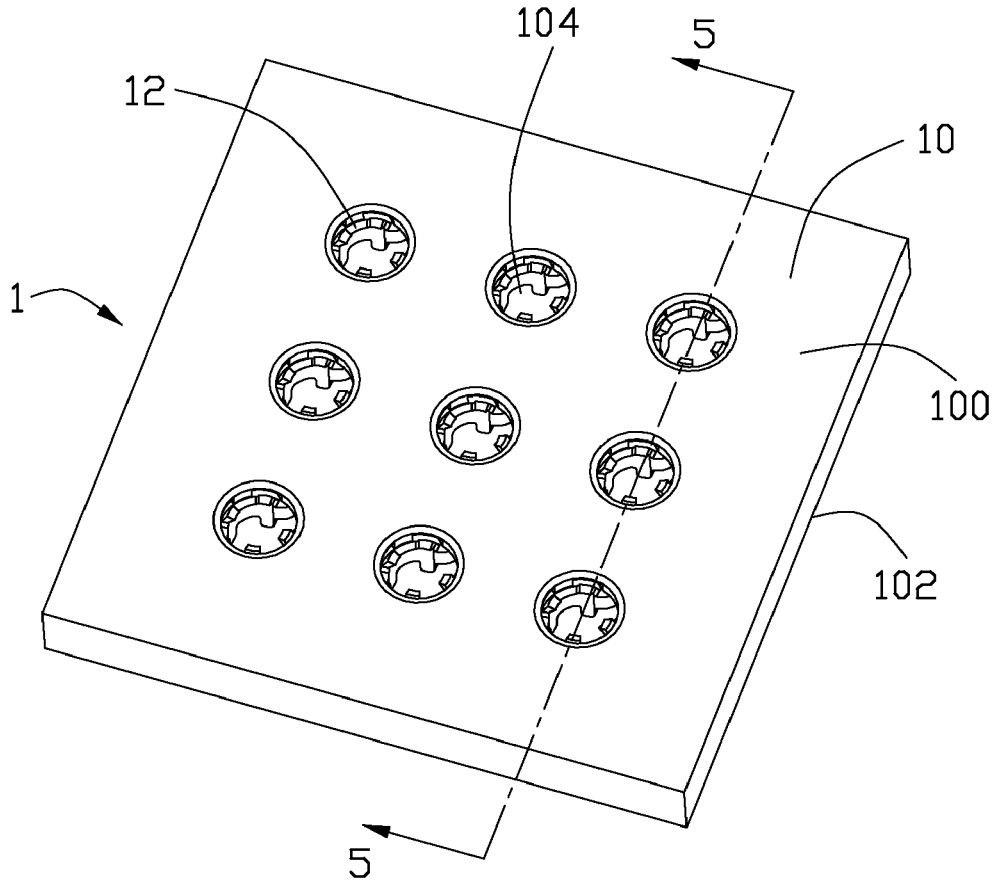
FIG. 1 is an isometric view of an electrical socket in accordance with a preferred embodiment of the present invention.
Figure 2:
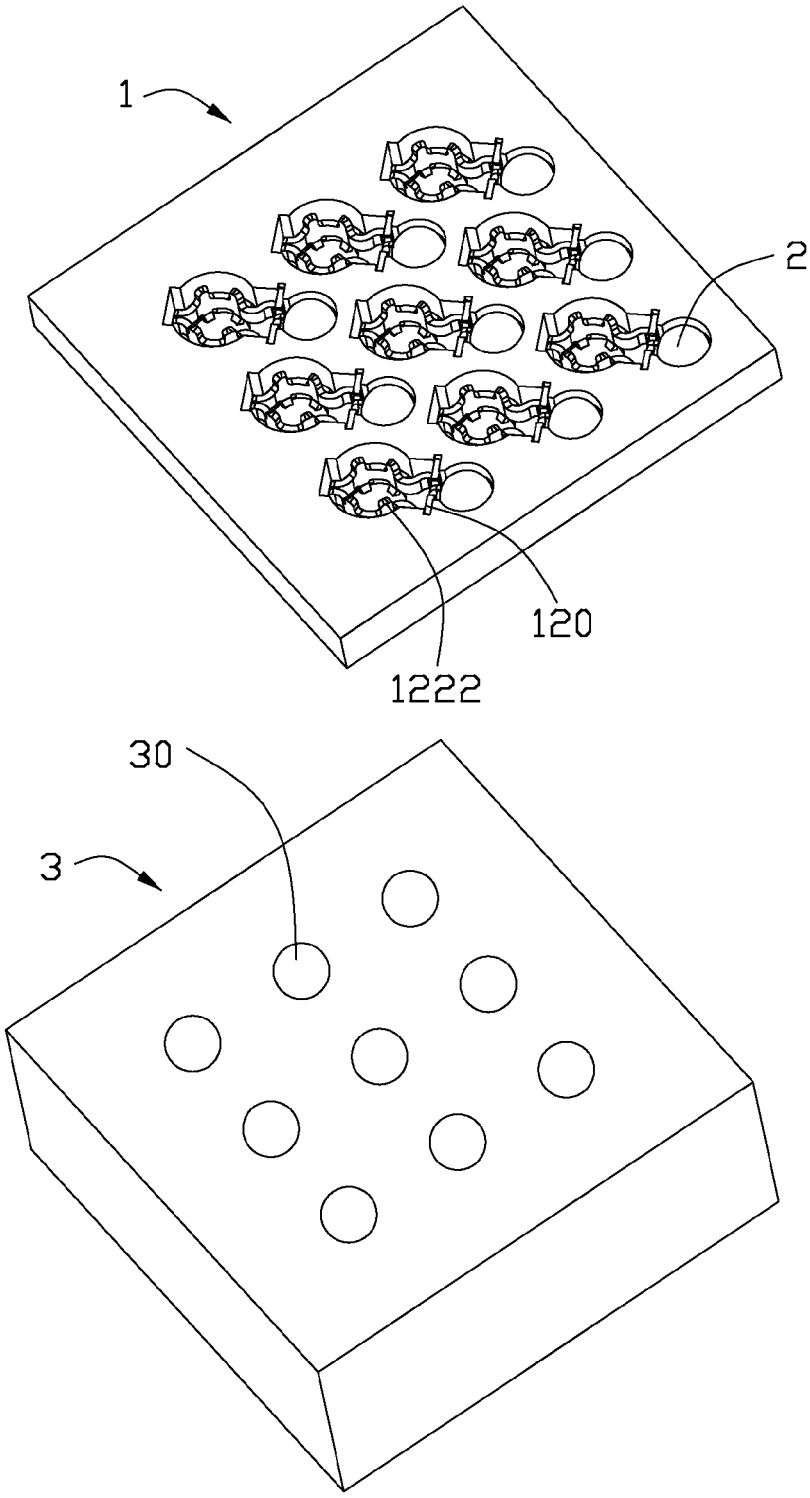
FIG. 2 is an isometric view of the electrical socket as shown in FIG. 1 and an IC package.
Figure 3:
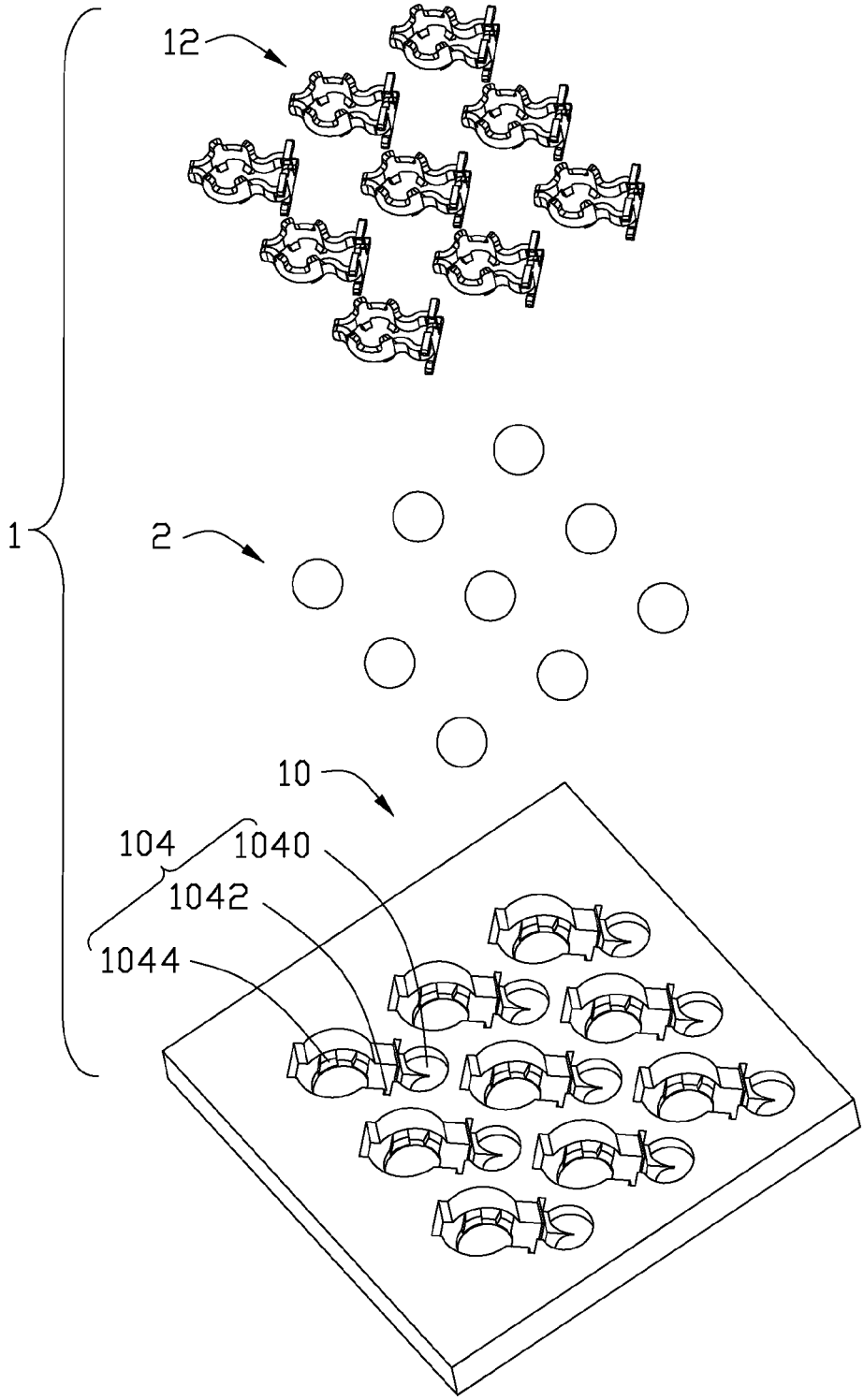
FIG. 3 is an isometric, exploded view of the electrical socket as shown in FIG. 1.
Figure 4:
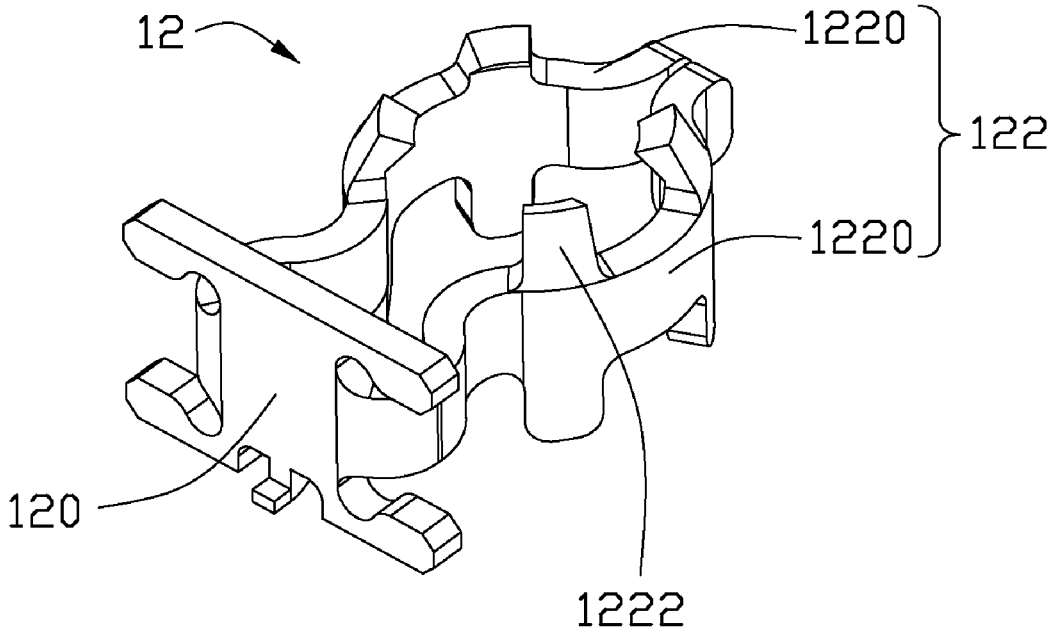
FIG. 4 is an isometric view of an electrical contact of the electrical socket as shown in FIG. 3.
Figure 5:
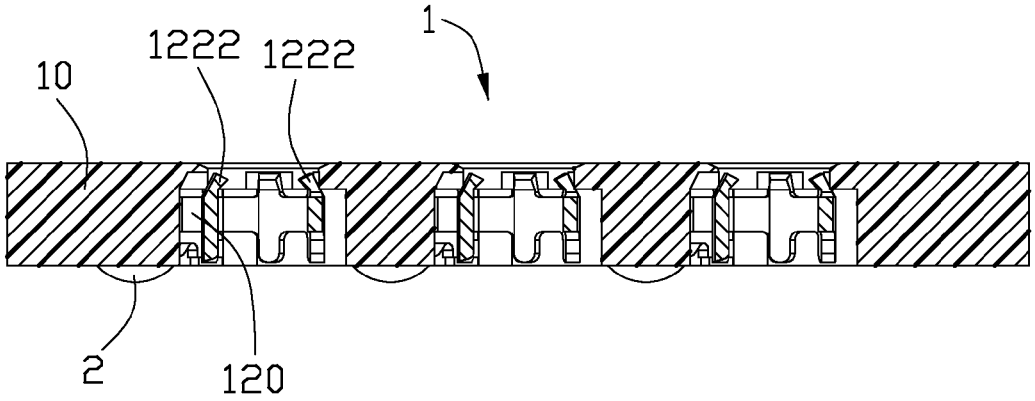
FIG. 5 is a cross-sectional view of the electrical socket of FIG. 1 taken along line 5-5 in FIG. 1.
Figure 6:
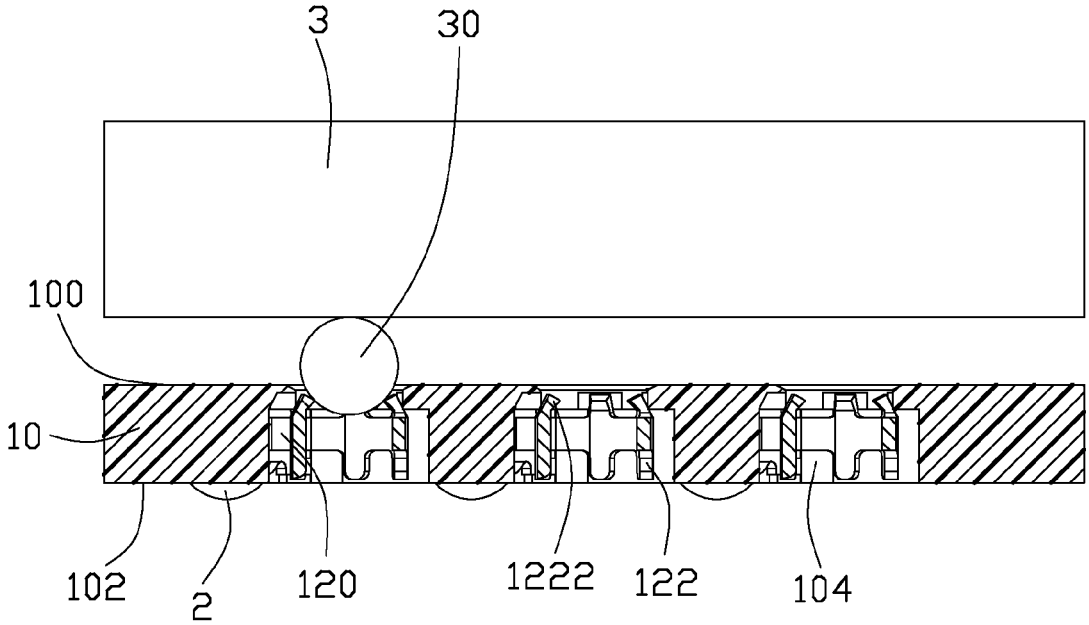
FIG. 6 is a cross-sectional view of an interconnecting assembly of the invention for using with the electrical socket for electrically connecting the electrical package shown in FIG. 2.

Referring to FIGS. 1-7, the electrical socket 1 of the present invention comprises an insulative housing 10 and a number of contacts 12. The insulative housing 1 defines an upper surface 100, a lower surface 102 opposite to the upper surface 100, and a number of passageways 104 extending vertically between the upper surface 100 and the lower surface 102. The passageway 104 is recessed from the lower surface 102 toward the upper surface 100. The passageway 104 comprises a first part 1040 for receiving a solder mass 2, a second part 1042 for receiving a retaining portion 120 of the contact 12 and a third part 1044 for receiving a solder ball 30 of an electrical component 30. In the present invention, only the third part 1044 extends through both the lower surface 102 and the upper surface 100. Those three parts are communicated with one another and disposed one by one along an extending direction of the upper surface 100.

The number of contacts 12 is received in corresponding passageway 104, respectively. The contact 12 further comprises a contacting portion 122 extending from the base portion 120. In the present invention, the contacting portion 122 is a pair of arms 1220 extending toward the upper surface 100 of the housing 10 from an edge of the base portion 120. Those two arms 1220 each define two hooks 1222 thereon, such that both the hooks 1222 forming a grasping space for nesting the solder ball 30 of the electrical component 3.

According to the present invention, the solder mass 32 for connecting the contact 12 to a PCB (Printed Circuit Board not shown) is received in the first part 1040 of the passageway 104 and attached on the base portion 120 of the contact 12. A lower end of the solder mass 2 arranged below the lower surface 102 of the housing 10. The solder ball 30 is grasped and positioned by the hooks 1222 of the contact 12. Thus, electrical connection between the electrical component 3 and the PCB will be established.

According to the present invention, those three parts of the passageway 104 are communicated with one another and disposed one by one along an extending direction of the upper surface 100. Therefore, after the contact 12 and the solder mass 2 are received in the passageway, the solder mass 2, base portion 120 and the contacting portion 122 are also disposed one by one along an extending direction of the upper surface 100. Obviously, thickness of the housing 10 between the upper surface 100 and lower surface 102 will be reduced. Thus, the electrical socket of the present is benefited with low profile suitable for compact and thin applications.

While the preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical socket for interconnecting two electronic components, comprising:

an insulative housing having an upper surface extending along a first direction;

a number of contacts received in the insulative housing, each contact comprising:

a base portion for retaining the contact received in the housing;

a contacting portion extending from the base portion; and a plurality of solder mass received in the housing and located aside a base portion of a contact, respectively; and wherein the base portion is located between the solder mass and the contacting portion along the first direction, and the solder mass is attached to the base portion.

2. The electrical socket as claimed in claim 1, wherein the contacting portion comprises a pair of arms extending from opposite edges of the base portion along the first direction and forming a receiving space therebetween.

3. The electrical socket as claimed in claim 2, wherein the two arms each defines two hooks thereon, such that both the hooks forming a grasping space for grasping a solder ball of an IC package.

4. The electrical contact as claimed in claim 3, wherein the solder mass is arranged to have a portion located below a lower surface of the housing.

5. An electrical socket for interconnecting two electronic components, comprising:

an insulative housing having a plurality of passageways extending between an upper surface and a lower surface; and a plurality of contacts each defining a retaining portion secured in corresponding passageways, respectively; wherein the passageways each comprises a first part for receiving a solder mass, a second part for receiving the retaining portion and a third part for receiving a solder ball of an electrical component; and wherein those three parts are communicated with one another and disposed one by one consecutively along an extending direction of the upper surface;

wherein the contact comprises a pair of arms extending along the extending direction of the upper surface such that creating an opening therebetween corresponding to the third part.

6. The electrical socket as claimed in claim 5, wherein the passageway is recessed from the lower surface of the housing, the first part extending through both the lower and upper surface.

7. The electrical socket as claimed in claim 5, wherein the two arms each defines two hooks thereon, such that both the hooks forming a grasping space for grasping the solder ball of the electrical component.

8. The electrical socket as claimed in claim 5, wherein the solder mass is arranged to have a portion located below a lower surface of the housing.

9. An electrical socket assembly comprising:

an insulative housing defining opposite upper and bottom faces with a plurality of passageways each having first and second parts side by side communicatively arranged with each other, said first part extending through at least the bottom face to receive partially a solder ball used for mounting to a mother board, and the second part extending through at least the upper face for receiving a conductor of an electronic package;

a plurality of contacts disposed in the corresponding passageways, respectively, each of said contacts defining a contacting section in the second part around the upper face for coupling to said conductor of the electronic package, and each of said solder balls being essentially fully horizontally offset from the corresponding contacting section.

10. The electrical socket assembly as claimed in claim 9, wherein at least one half of each of said solder balls is received in the first part of the corresponding passageway.

11. The electrical socket assembly as claimed in claim 9, wherein each of said contacts defines a base portion lying in a vertical plane, and the corresponding contacting section extends from said base portion.

12. The electrical socket assembly as claimed in claim 11, wherein said base portion is located around a boundary between the first part and the second part.

13. The electrical socket assembly as claimed in claim 11, wherein said contacting sections includes a pair of arms extending horizontally from two opposite side edges of the base portion.

14. The electrical socket as claimed in claim 13, wherein said pair of arms are symmetrical with each other with regard to the base portion.

15. The electrical socket assembly as claimed in claim 13, wherein said arms extend in a curved manner to commonly form a circle in a top view.

16. The electrical socket assembly as claimed in claim 15, wherein one claw is formed on a horizontal upper edge of each of said arms for coupling to the conductor of said electronic package.

17. The electrical socket as claimed in claim 16, wherein said claw inwardly extends toward a centerline of said circle.

18. The electrical socket as claimed in claim 13, wherein at least one tab formed on a horizontal lower edge of each of said arms.

19. The electrical socket as claimed in claim 9, wherein the housing defines a plurality of stepped structures around the upper face in alignment with the corresponding passageways, respectively.

20. The electrical socket as claimed in claim 9, wherein the second part further extends through the bottom face.

* * * * *